US010559183B2

(12) United States Patent
Ishida et al.

(10) Patent No.: US 10,559,183 B2
(45) Date of Patent: Feb. 11, 2020

(54) ACTIVITY AMOUNT CALCULATION SYSTEM, ACTIVITY AMOUNT CALCULATION DEVICE, ACTIVITY AMOUNT CALCULATION METHOD, AND COMPUTER-READABLE RECORDING MEDIUM

(71) Applicants: NEC Solution Innovators, Ltd., Tokyo (JP); National University Corporation Kanazawa University, Ishikawa (JP)

(72) Inventors: Kazuo Ishida, Tokyo (JP); Mayumi Kato, Ishikawa (JP); Kazuyo Kitaoka, Ishikawa (JP); Miho Shogenji, Ishikawa (JP)

(73) Assignees: NEC Solution Innovators, Ltd., Tokyo (JP); National University Corporation Kanazawa University, Ishikawa (JP)

( * ) Notice: Subject to any disclaimer, the term of this patent is extended or adjusted under 35 U.S.C. 154(b) by 0 days.

(21) Appl. No.: 15/562,140

(22) PCT Filed: Mar. 30, 2016

(86) PCT No.: PCT/JP2016/060366
§ 371 (c)(1),
(2) Date: Sep. 27, 2017

(87) PCT Pub. No.: WO2016/159067
PCT Pub. Date: Oct. 6, 2016

(65) Prior Publication Data

US 2018/0082562 A1 Mar. 22, 2018

(30) Foreign Application Priority Data

Mar. 31, 2015 (JP) ..... 2015-073769

(51) Int. Cl.
*G08B 21/22* (2006.01)
*G08B 25/04* (2006.01)
(Continued)

(52) U.S. Cl.
CPC ..... *G08B 21/0423* (2013.01); *G08B 21/182* (2013.01)

(58) Field of Classification Search
CPC ..... G08B 21/0423
See application file for complete search history.

(56) References Cited

U.S. PATENT DOCUMENTS 6,989,742 B2 1/2006 Ueno et al.
2003/0117279 A1 6/2003 Ueno et al.
(Continued)

FOREIGN PATENT DOCUMENTS

GB 2443274 A 4/2008
JP 2000-123273 A 4/2000
(Continued)

OTHER PUBLICATIONS

International Search Report corresponding to PCT/JP2016/060366, 1 page, dated May 10, 2016.
(Continued)

*Primary Examiner* — Joseph H Feild
*Assistant Examiner* — Pameshanand Mahase
(74) *Attorney, Agent, or Firm* — Wilmer Cutler Pickering Hale and Dorr LLP

(57) ABSTRACT

An activity amount calculation system includes a plurality of detection units and an activity amount calculation device. The plurality of detection units detect a resident and output detection signals when the resident passes through doorways of a plurality of rooms. The calculation device includes a calculation unit and a summation unit. Upon detection of the resident by the detection units, the calculation unit calculates
(Continued)

an activity amount of the resident based on relationships between detection units and reference activity amounts. The summation unit repeatedly calculates a total activity amount of the resident in a predetermined period by summing activity amounts calculated by the calculation unit.

15 Claims, 7 Drawing Sheets

(51) Int. Cl.
*G08B 21/04* (2006.01)
*G08B 21/18* (2006.01)

(56) References Cited

U.S. PATENT DOCUMENTS

| | | | | |
|---|---|---|---|---|
| 2005/0131736 | A1* | 6/2005 | Nelson | G06Q 50/22 705/2 |
| 2010/0127921 | A1* | 5/2010 | Chen | G06Q 30/02 705/319 |
| 2014/0074504 | A1 | 3/2014 | Nelson et al. | |
| 2014/0266791 | A1* | 9/2014 | Lloyd | H04Q 9/00 340/870.09 |
| 2015/0120596 | A1* | 4/2015 | Fadell | G08B 27/003 705/330 |
| 2015/0127712 | A1* | 5/2015 | Fadell | G06Q 10/083 709/202 |
| 2018/0206009 | A1 | 7/2018 | Lloyd et al. | |

FOREIGN PATENT DOCUMENTS

| | | | |
|---|---|---|---|
| JP | 2004-204629 | A | 7/2004 |
| JP | 2006-320566 | A | 11/2006 |
| JP | 2008-052631 | A | 3/2008 |
| JP | 2010-165088 | A | 7/2010 |
| JP | 2015-060329 | A | 3/2015 |
| KR | 2014-0088004 | A | 7/2014 |
| WO | WO-03044755 | A1 | 5/2003 |

OTHER PUBLICATIONS

Extended European Search Report issued by the European Patent Office for European Application No. 16772948.2 dated Sep. 13, 2018 (8 pages).

Japanese Office Action dated Feb. 12, 2019 received in related Japanese Patent Application No. 2017-510095 (5 pages).

Korean Office Action dated Nov. 18, 2018 received in related Korean Patent Application No. 10-2017-7031222 (13 pages).

Japanese Decision to Grant a Patent issued in Japanese Patent Application No. 2017-510095, dated Sep. 10, 2019, 3 pages.

Nishioka Tsutomu, Kikuchi Toshiyuki and Namba, The example of the life rhythm information analysis-system actual proof experiment in Takashi and in home welfare support system Mizusawa that watch in the area, the Hitachi criticism, Hitachi Hyoronsha, "Home Welfare Supporting Systems for the Aged in Community", Sep. 1, 2001, the 83rd vol., No. 9, pp. 27-30 (4 pages).

* cited by examiner

Fig.4

| | DETECTION UNITS | | | | | |
|---|---|---|---|---|---|---|
| | D1 | D2 | D3 | D4 | D5 | D6 |
| DETECTION TIMES | | | | 8:15:20 | | |
| | | | 8:15:24 | | | |
| | | | 10:00:43 | | | |
| | | 10:00:48 | | | | |
| | | 10:03:12 | | | | |
| | | | 10:03:16 | | | |

Fig.5

| | | | DETECTION UNIT THAT DETECTED RESIDENT SECOND | | | | | |
|---|---|---|---|---|---|---|---|---|
| | | | D1 | D2 | D3 | D4 | D5 | D6 |
| DETECTION UNIT THAT DETECTED RESIDENT FIRST | D1 | REFERENCE ACTIVITY AMOUNT | - | 3m | 3m | 5m | 7m | - |
| | | REFERENCE PERIOD | - | 3s | 3s | 5s | 7s | - |
| | D2 | REFERENCE ACTIVITY AMOUNT | 3m | - | 2m | 5m | 7m | - |
| | | REFERENCE PERIOD | 3s | - | 2s | 5s | 7s | - |
| | D3 | REFERENCE ACTIVITY AMOUNT | 3m | 2m | - | 5m | 7m | 7m |
| | | REFERENCE PERIOD | 3s | 2s | - | 5s | 7s | 7s |
| | D4 | REFERENCE ACTIVITY AMOUNT | 5m | 5m | 5m | - | 2m | - |
| | | REFERENCE PERIOD | 5s | 5s | 5s | - | 2s | - |
| | D5 | REFERENCE ACTIVITY AMOUNT | 7m | 7m | 7m | 2m | - | 3m |
| | | REFERENCE PERIOD | 7s | 7s | 7s | 2s | - | 3s |
| | D6 | REFERENCE ACTIVITY AMOUNT | - | - | 7m | - | 3m | - |
| | | REFERENCE PERIOD | - | - | 7s | - | 3s | - |

ACTIVITY AMOUNT CALCULATION SYSTEM, ACTIVITY AMOUNT CALCULATION DEVICE, ACTIVITY AMOUNT CALCULATION METHOD, AND COMPUTER-READABLE RECORDING MEDIUM

CROSS-REFERENCE TO RELATED APPLICATIONS

This application is a national stage application of International Application No. PCT/JP2016/060366 entitled "ACTIVITY AMOUNT CALCULATION SYSTEM, ACTIVITY AMOUNT CALCULATION DEVICE, ACTIVITY AMOUNT CALCULATION METHOD, AND COMPUTER-READABLE RECORDING MEDIUM," filed on Mar. 30, 2016, which claims the benefit of the priority of Japanese Patent Application No. 2015-073769 filed on Mar. 31, 2015, the disclosures of each of which are hereby incorporated by reference in their entirety.

TECHNICAL FIELD

The present invention relates to an activity amount calculation system, an activity amount calculation device, an activity amount calculation method, and a computer-readable recording medium having recorded therein a program for realizing them.

BACKGROUND ART

In recent years, the population of elderly people living alone is growing rapidly. The family of an elderly person living away from the family needs to visit a dwelling of the elderly person or call the elderly person to check the health condition and the like of the elderly person. However, frequent visits to the dwelling of the elderly person create a large temporal and financial burden on the family. Furthermore, it is difficult to check the health condition of the elderly person with certainty simply by calling the elderly person. Moreover, the family may unnecessarily feel anxious if the elderly person does not answer the phone due to, for example, absence from home.

To reduce such a burden on the family, for example, an emergency report device or a device for informing the family of good health can be installed in the dwelling of the elderly person. However, in this case, the elderly person needs to operate the device; if he/she forgets to perform, for example, a pressing operation, the family may not be able to appropriately grasp the health condition of the elderly person. In view of this, a system for appropriately grasping the health condition of an elderly person has been conventionally developed.

For example, Patent Document 1 discloses a system that stores data of lifestyle behaviors of an elderly person detected by a plurality of sensors installed in a home, and enables the lifestyle behaviors of the elderly person to be checked using the stored data.

In addition to a system for checking the health condition of an elderly person, a method of detecting behaviors of a person has been conventionally offered. For example, Patent Document 2 discloses a system in which a minimum period required for a user to move between authentication terminals is preset, and when a difference between the operation time on an authentication terminal at the start of movement and the operation time on an authentication terminal at the destination of movement is shorter than the minimum period, the system determines that a fraudulent operation is performed.

LIST OF PRIOR ART DOCUMENTS

Patent Documents

Patent Document 1: JP 2000-123273A
Patent Document 2: JP 2004-204629A

DISCLOSURE OF THE INVENTION

Problems to be Solved by the Invention

As described above, lifestyle behaviors of an elderly person can be checked using the system disclosed in Patent Document 1. Specifically, for example, a period taken by the elderly person to flush a toilet, a period taken by the elderly person to make a phone call, and so forth can be grasped. However, as a change in an activity amount of the elderly person cannot be grasped, it is difficult to grasp a change in the health condition of the elderly person.

Meanwhile, a decrease in the walking speed of an elderly person may be grasped using the system disclosed in Patent Document 2. However, when the system of Patent Document 2 is used, the elderly person needs to operate authentication terminals, that is, a burden on the elderly person cannot be sufficiently reduced. Furthermore, with the system of Patent Document 2, although the minimum period required to move between authentication terminals needs to be set, it is difficult to set a minimum period taken to precisely grasp a change in the health condition of the elderly person.

An example of an object of the present invention is to provide an activity amount calculation system, an activity amount calculation device, an activity amount calculation method, and a computer-readable recording medium that solve the foregoing problems by enabling a change in an activity amount of a resident to be precisely grasped while reducing a burden on the resident.

Means for Solving the Problems

To achieve the foregoing object, an activity amount calculation system according to one aspect of the present invention calculates activity amounts of a resident of a dwelling equipped with a plurality of rooms, the activity amount calculation system including:

a plurality of detection units configured to detect the resident and output detection signals when the resident passes through doorways of the plurality of rooms;

a calculation unit configured to calculate activity amounts of the resident based on the detection signals output from the plurality of detection units; and a summation unit configured to repeatedly calculate a total activity amount of the resident in a predetermined period by summing the activity amounts calculated by the calculation unit, wherein upon detection of the resident by different detection units included among the plurality of detection units, the calculation unit calculates an activity amount of the resident based on a preset relationship between the different detection units and a reference activity amount.

To achieve the foregoing object, an activity amount calculation device according to another aspect of the present invention calculates activity amounts of a resident of a dwelling equipped with a plurality of rooms, the activity amount calculation device including:

a calculation unit configured to calculate activity amounts of the resident based on detection signals output from a plurality of detection devices that detect the resident when the resident passes through doorways of the plurality of rooms; and a summation unit configured to repeatedly calculate a total activity amount of the resident in a predetermined period by summing the activity amounts calculated by the calculation unit, wherein upon detection of the resident by different detection devices included among the plurality of detection devices, the calculation unit calculates an activity amount of the resident based on a preset relationship between the different detection devices and a reference activity amount.

To achieve the foregoing object, an activity amount calculation method according to still another aspect of the present invention calculates activity amounts of a resident of a dwelling equipped with a plurality of rooms using an activity amount calculation device, the activity amount calculation method including:

(a) a step of calculating activity amounts of the resident based on detection signals output from a plurality of detection devices that detect the resident when the resident passes through doorways of the plurality of rooms; and (b) a step of repeatedly calculating a total activity amount of the resident in a predetermined period by summing the activity amounts calculated in step (a), wherein in step (a), upon detection of the resident by different detection devices included among the plurality of detection devices, an activity amount of the resident is calculated based on a preset relationship between the different detection devices and a reference activity amount.

To achieve the foregoing object, a computer-readable recording medium according to still another aspect of the present invention has recorded therein a program for calculating activity amounts of a resident of a dwelling equipped with a plurality of rooms using a computer, the program including an instruction for causing the computer to execute:

(a) a step of calculating activity amounts of the resident based on detection signals output from a plurality of detection devices that detect the resident when the resident passes through doorways of the plurality of rooms; and (b) a step of repeatedly calculating a total activity amount of the resident in a predetermined period by summing the activity amounts calculated in step (a), wherein in step (a), upon detection of the resident by different detection devices included among the plurality of detection devices, an activity amount of the resident is calculated based on a preset relationship between the different detection devices and a reference activity amount.

Advantageous Effects of the Invention

As described above, according to the present invention, a change in an activity amount of a resident can be precisely grasped while reducing a burden on the resident.

BRIEF DESCRIPTION OF THE DRAWINGS

FIG. 4 shows an example of a relationship between detection units and detection times stored in a detection information storage unit.

FIG. 5 shows an example of relationships between detection units and reference activity amounts prestored in an installation information storage unit.

MODE FOR CARRYING OUT THE INVENTION

Embodiment

The following describes an activity amount calculation system, an activity amount calculation method, and a program according to an embodiment of the present invention with reference to FIGS. 1 to 7.

System Configuration

Figure 1:
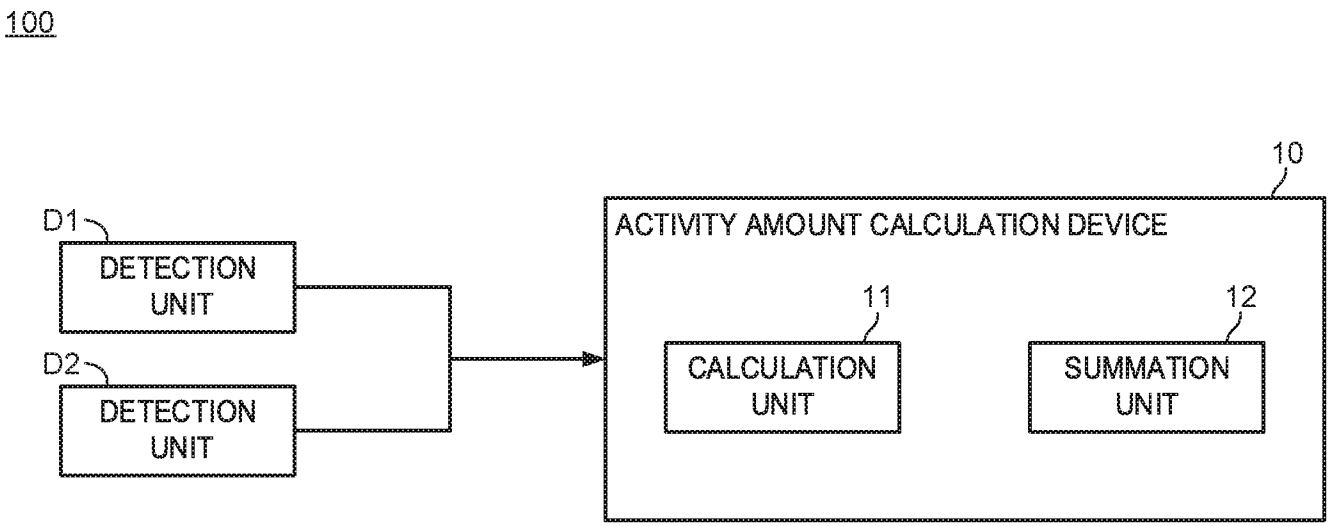
FIG. 1 shows a general configuration of an activity amount calculation system according to an embodiment of the present invention.

First, a configuration of the activity amount calculation system will be described with reference to FIG. 1. FIG. 1 shows a general configuration of the activity amount calculation system according to the embodiment of the present invention.

Referring to FIG. 1, an activity amount calculation system (hereinafter simply referred to as a "calculation system" as well) 100 according to the present embodiment includes an activity amount calculation device 10 and a plurality of (in the present embodiment, two) detection units D1 and D2. The calculation system 100 calculates activity amounts of a resident of a dwelling equipped with a plurality of rooms.

Detection signals output by the plurality of detection units D1 and D2 are input to the activity amount calculation device (hereinafter simply referred to as a "calculation device" as well) 10. As will be described later in detail, the plurality of detection units D1 and D2 detect the resident and output the detection signals when the resident passes through doorways of the plurality of rooms.

The calculation device 10 includes a calculation unit 11 and a summation unit 12. Upon detection of the resident by the detection units D1 and D2, the calculation unit 11 calculates an activity amount of the resident based on later-described relationships between detection units and reference activity amounts. The summation unit 12 repeatedly calculates a total activity amount of the resident in a predetermined period by summing activity amounts calculated by the calculation unit 11.

In the calculation system 100 according to the present embodiment, the calculation unit 11 calculates an activity amount of the resident based on the detection signals that are output by the detection units D1 and D2 when the resident passes through the doorways of the rooms. As will be described later in detail, the calculation unit 11 calculates the activity amount of the resident based on the preset relationships between detection units and reference activity amounts. In this case, the activity amount of the resident can be calculated easily and precisely by presetting a relationship between the detection units D1 and D2 and an activity amount in consideration of a room arrangement. Furthermore, the summation unit 12 repeatedly calculates a total activity amount of the resident in a predetermined period. In this case, a change in the health condition of the resident can easily be grasped by checking a change in the total activity amount. Moreover, the calculation system 100 neither requires the resident to carry, for example, a device for measuring activity amounts, nor requires the resident to perform, for example, a special operation to measure activity amounts. Therefore, a burden on the resident can be sufficiently reduced.

As described above, with the calculation system 100 according to the present embodiment, a change in an activity amount of the resident can be precisely grasped while reducing a burden on the resident. Therefore, with the calculation system 100 according to the present embodiment, for example, a change in an activity amount of an elderly person living alone away from his/her family can be grasped, and consequently, the health condition of the elderly person can be precisely grasped.

Figure 2:
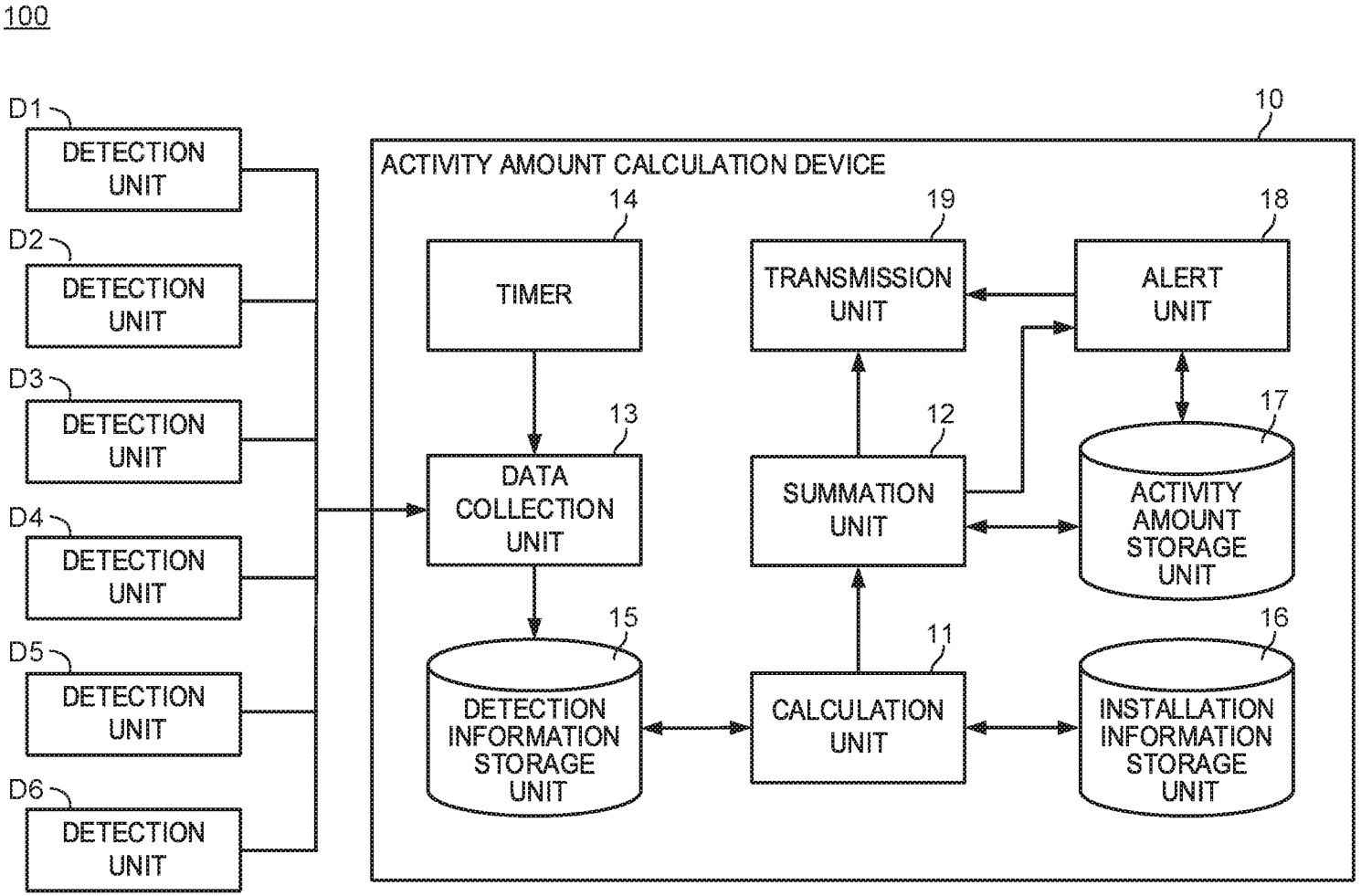
FIG. 2 is a block diagram showing a specific configuration of the activity amount calculation system according to the embodiment of the present invention.

Next, a specific configuration of the calculation system according to the present embodiment will be described with reference to FIG. 2. FIG. 2 is a block diagram showing the specific configuration of the calculation system.

As shown in FIG. 2, in the present embodiment, the calculation system 100 includes a plurality of detection units D1 to D6 and the calculation device 10. In the present embodiment, the plurality of detection units D1 to D6 are connected to the calculation device 10 via, for example, a wired or wireless network. In the present embodiment, the detection units D1 to D6 are detection devices that detect the resident and output detection signals. Motion sensors that detect a person using, for example, infrared, ultrasound, or visible light can be used as the detection units D1 to D6.

Prior to a description of a detailed configuration of the calculation device 10, a brief description of an example of installation of the calculation system 100 in a dwelling will now be given.

Figure 3:
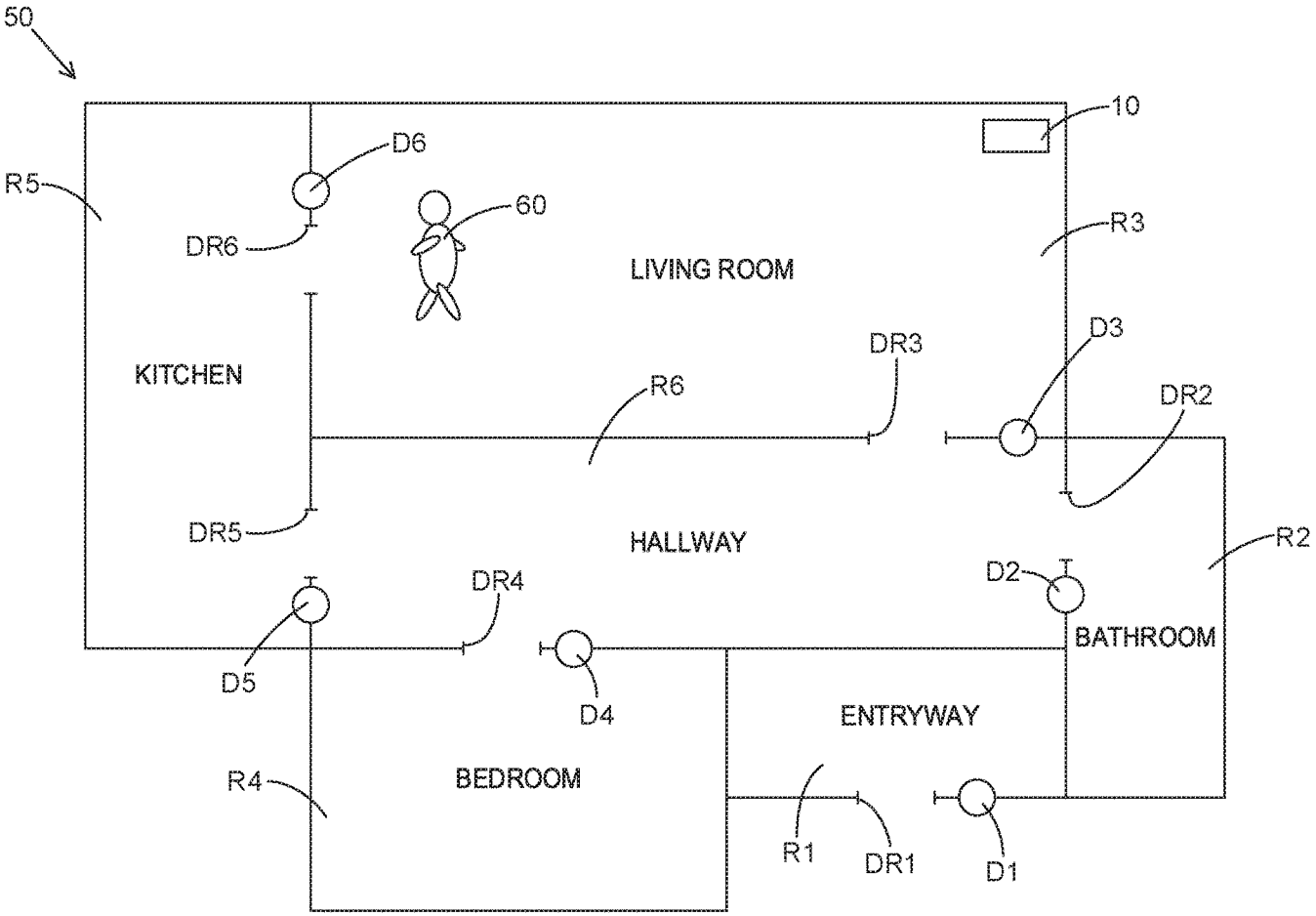
FIG. 3 shows an example of installation of the activity amount calculation system in a dwelling equipped with a plurality of rooms.

FIG. 3 shows an example of installation of the calculation system in a dwelling equipped with a plurality of rooms.

A dwelling 50 shown in FIG. 3 has an entryway R1, a bathroom R2, a living room R3, a bedroom R4, and a kitchen R5 as the plurality of rooms. The dwelling 50 also has a hallway R6. The entryway R1, bathroom R2, living room R3, bedroom R4, and kitchen R5 are connected by the hallway R6. In the example of FIG. 3, the calculation device 10 is installed in the living room R3.

Each room has a doorway(s). In the present embodiment, the dwelling 50 has doorways DR1 to DR6. The detection units D1 to D6 are provided in correspondence with the doorways DR1 to DR6, respectively. Each of the detection units D1 to D6 detects a resident 60 and outputs a detection signal to the calculation device 10 when the resident 60 passes through a corresponding one of the doorways DR1 to DR6. Instead of motion sensors, pressure sensors may be provided as the detection units D1 to D6. In this case, the floor may be equipped with the pressure sensors to detect the resident 60 based on a change in a detected pressure. Furthermore, image capturing devices may be used as the detection units D1 to D6 to detect the resident 60.

A description is now given of the configuration of the calculation device 10.

Referring to FIG. 2, the calculation device 10 includes a data collection unit 13, a timer 14, a detection information storage unit 15, an installation information storage unit 16, an activity amount storage unit 17, an alert unit 18, and a transmission unit 19 in addition to the aforementioned calculation unit 11 and summation unit 12.

Detection signals output from the detection units D1 to D6 are input to the data collection unit 13. When a detection signal is input from any of the detection units D1 to D6 to the data collection unit 13, the data collection unit 13 obtains date/time information from the timer 14. The data collection unit 13 uses the time of input of the detection signal as the time of detection of the resident 60 by the corresponding detection unit, and stores the time of detection to the detection information storage unit 15 in association with the corresponding detection unit. Accordingly, the times of detection of the resident 60 are each stored in the detection information storage unit 15 in association with a corresponding one of the detection units D1 to D6. When each of the detection units D1 to D6 has a function of transmitting the time of detection of the resident 60 to the data collection unit 13 together with a detection signal, the calculation device 10 need not include the timer 14.

Relationships between the detection units D1 to D6 and activity amounts are prestored in the installation information storage unit 16. The calculation unit 11 calculates activity amounts of the resident 60 based on the detection times that are each stored in the detection information storage unit 15 in association with a corresponding one of the detection units D1 to D6, and on the foregoing relationships stored in the installation information storage unit 16. A brief description of a method of calculating activity amounts will now be given.

FIG. 4 shows an example of a relationship between detection units and detection times stored in the detection information storage unit 15. FIG. 5 shows an example of relationships between detection units and reference activity amounts prestored in the installation information storage unit 16. Specifically, referring to the relationships of FIG. 5, each pair of detection units is shown in association with a corresponding reference activity amount. In the example of FIG. 5, reference periods are shown in addition to the reference activity amounts. In the present embodiment, distances that are set in consideration of the actual installation positions of the detection units D1 to D6 are used as the reference activity amounts. Similarly, the reference periods are set in consideration of the actual installation positions of the detection units D1 to D6.

For example, in the example of FIG. 4, the detection unit D4 detected the resident 60 at fifteen minutes and twenty seconds past eight o'clock, and the detection unit D3 detected the resident 60 at fifteen minutes and twenty-four seconds past eight o'clock. This means that the resident 60 passed through the doorway DR4 to exit the bedroom R4 (see FIG. 3), and thereafter passed through the doorway DR3 to enter the living room R3 (see FIG. 3). An elapsed period between detection by the first detection unit D4 and detection by the second detection unit D3 is four seconds. This means that the resident 60 took four seconds to move from the bedroom R4 to the living room R3.

In this case, the calculation unit 11 calculates an activity amount of the resident 60 moving from the bedroom R4 to the living room R3 as follows. First, the calculation unit 11 acknowledges the detection unit D4 as the detection unit that detected the resident 60 first (the first detection unit), and the detection unit D3 as the detection unit that detected the resident 60 second (the second detection unit). Based on the relationships shown in FIG. 5, the calculation unit 11 determines that a corresponding reference activity amount is 5 m.

Next, the elapsed period is compared with a corresponding reference period shown in FIG. 5. When the elapsed period is longer than or equal to the reference period, the calculation unit 11 uses the reference activity amount as the activity amount of the resident 60. On the other hand, when the elapsed period is shorter than the reference period, the calculation unit 11 uses a product of the reference activity amount and a coefficient larger than one (e.g., 1.75) as the activity amount of the resident 60. In the foregoing example, as the elapsed period is four seconds and thus shorter than the reference period, the calculation unit 11 uses the product of the reference activity amount (5 m) and the coefficient as the activity amount of the resident 60. By thus multiplying the reference activity amount by the coefficient, the activity amount can be calculated in consideration of the intensity of exercise (the speed of movement) by the resident 60.

The summation unit 12 repeatedly calculates a total activity amount of the resident 60 in a predetermined period by summing activity amounts calculated by the calculation unit 11. The summation unit 12 also stores the calculated total activity amount to the activity amount storage unit 17, and transmits the calculated total activity amount to the alert unit 18 and the transmission unit 19. The predetermined period can be adjusted as appropriate. For example, in order to obtain daily activity amounts of the resident 60, it is sufficient to set the predetermined period to 24 hours. In this case, daily total activity amounts are stored in the activity amount storage unit 17.

The alert unit 18 generates an alert signal based on the total activity amount input from the summation unit 12 (the current total activity amount) and on total activity amounts stored in the activity amount storage unit 17, and outputs the generated alert signal to the transmission unit 19. Specifically, based on the total activity amounts stored in the activity amount storage unit 17, the alert unit 18 calculates an average value of a predetermined number of (e.g., a week's worth of) total activity amounts that were calculated by the summation unit 12 in and before the last calculation. The alert unit 18 generates the alert signal when a difference between the total activity amount input by the summation unit 12 (the current total activity amount) and the average value exceeds a preset threshold. This threshold is set in such a manner that the alert unit 18 generates the alert signal when, for example, the total activity amount of the resident 60 has significantly increased or decreased.

The alert unit 18 may be configured to generate the alert signal when the current total activity amount exceeds a preset upper limit and when the current total activity amount falls below a preset lower limit. In this case, the upper limit and the lower limit can be determined in consideration of, for example, activity amounts of people of the same age as the resident 60.

The transmission unit 19 transmits the total activity amount input by the summation unit 12 to a non-illustrated external terminal (e.g., a personal computer, smartphone, or tablet terminal) used by a family who lives away from the resident 60 via a network, such as the Internet. This enables the family who lives away from the resident 60 to, for example, check the total activity amount of the resident 60 and precisely grasp the health condition of the resident 60.

When the alert signal is input from the alert unit 18 to the transmission unit 19, the transmission unit 19 issues an alert to the external terminal by transmitting the alert signal thereto. Accordingly, the family of the resident 60 can be informed of, for example, a significant increase or decrease in the activity amounts of the resident 60. As a result, the family can acknowledge the possibility of an abnormality in the health condition of the resident 60. With such issuance of the alert, the present embodiment does not require the family to constantly check the health condition of the resident 60. This reduces a burden on the family. The transmission unit 19 may, for example, issue the alert to the external terminal by e-mail instead of transmitting the alert signal to the external terminal.

The calculation device 10 can be constructed by, for example, installing the program in a computer. One or more computers may be used to construct the calculation device 10. For example, the detection information storage unit 15, installation information storage unit 16, and activity amount storage unit 17 may be connected as external storage devices to a computer equipped with the calculation unit 11, summation unit 12, data collection unit 13, timer 14, alert unit 18, and transmission unit 19.

[System Operations]

Next, the operations of the calculation system according to the embodiment of the present invention will be described with reference to FIG. 6. In the following description, FIG. 2 will be referred to as appropriate.

In the present embodiment, the activity amount calculation method is implemented by causing the activity amount calculation system 100 to operate. Therefore, the following description of the operations of the activity amount calculation system 100 applies to the activity amount calculation method according to the present embodiment.

Figure 6:
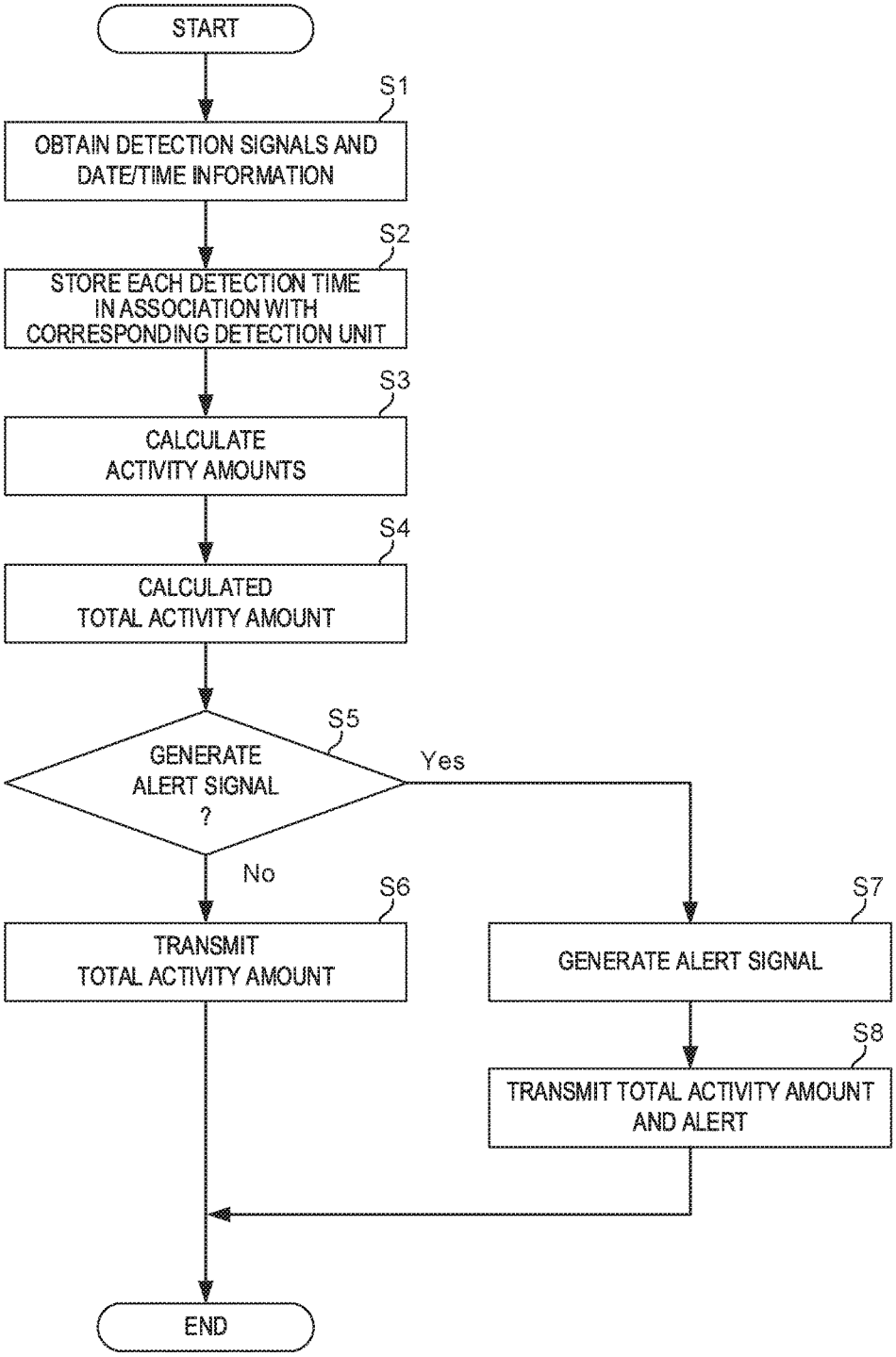
FIG. 6 is a flowchart of the operations of the activity amount calculation system according to the embodiment of the present invention.

FIG. 6 is a flowchart of the operations of the activity amount calculation system according to the embodiment of the present invention.

Referring to FIG. 6, in the calculation device 10, the data collection unit 13 first obtains detection signals from the detection units D1 to D6, and obtains date/time information from the timer 14 (step S1). Next, based on the detection signals and date/time information obtained in step S1, the data collection unit 13 stores each detection time to the detection information storage unit 15 in association with the corresponding detection unit (step S2).

Next, the calculation unit 11 calculates activity amounts based on the detection times that are each stored in the detection information storage unit 15 in association with the corresponding detection unit, and on the relationships between detection units and reference activity amounts stored in the installation information storage unit 16 (step S3). Next, the summation unit 12 calculates a total activity amount of the resident 60 in a predetermined period by summing activity amounts calculated by the calculation unit 11 (step S4). In step S4, the summation unit 12 also stores the calculated total activity amount to the activity amount storage unit 17, and transmits the calculated total activity amount to the alert unit 18 and the transmission unit 19.

Next, the alert unit 18 determines whether to generate an alert signal based on the total activity amount input from the summation unit 12 and on total activity amounts stored in the activity amount storage unit 17 (step S5). If the alert unit 18 determines that the alert signal is not to be generated, the transmission unit 19 transmits the total activity amount input from the summation unit 12 to an external terminal (step S6). Then, the calculation device 10 ends processing.

On the other hand, if the alert unit 18 determines in step S5 that the alert signal is to be generated, the alert unit 18 generates the alert signal, and transmits the alert signal to the transmission unit 19 (step S7). Next, the transmission unit 19 transmits the total activity amount input from the summation unit 12 and the alert signal input from the alert unit 18 to the external terminal (step S8). Then, the calculation device 10 ends processing.

In the present embodiment, for example, the calculation device 10 executes processes of steps S1 and S2 each time detection signals are input from the detection units D1 to D6, and executes processes of steps S3 to S8 every predetermined period.

MODIFICATION EXAMPLES

In the foregoing embodiment, the plurality of detection units and the calculation device are installed in the dwelling together. Alternatively, the calculation device may not be installed in the dwelling. For example, the calculation device may be configured on a cloud server. In this case, the plurality of detection units are configured to be capable of transmitting detection signals and signals indicating the detection times to the calculation device via the Internet. When the calculation device is configured on the cloud server, for example, the alert may be issued only to a particular user. Specifically, a user who wants the alert to be issued to him/herself may be charged.

Although distances that are set in consideration of the actual installation of the detection units D1 to D6 are used as the reference activity amounts in the foregoing embodiment, a method of defining the reference activity amounts is not limited to the foregoing example. For example, when there is a level difference (e.g., stairs) between a detection unit and another detection unit, a reference activity amount set between these detection units may be larger than a reference activity amount set between other detection units with a similar interval of distance.

In the foregoing embodiment, when detection signals are output sequentially from the same detection unit, the calculation unit 11 does not calculate an activity amount. Alternatively, the calculation device 10 may be configured such that the calculation unit 11 calculates an activity amount also when detection signals are output sequentially from the same detection unit. For example, the calculation device 10 may be configured such that the calculation unit 11 calculates an activity amount in accordance with a period of stay in each room. Specifically, the calculation unit 11 may calculate an activity amount in consideration of a period of stay in a bathroom, a shower room, and so forth.

Although the detection units D1 to D6 are respectively provided in correspondence with the doorways DR1 to DR6 in the foregoing embodiment, a detection unit may also be provided inside each room. In this case, activity amounts of the resident 60 can be calculated more accurately.

A method of issuing the alert is not limited to the foregoing example. The alert may be issued using, for example, a telephone, a facsimile machine, or a revolving light.

In the foregoing embodiment, for example, after a detection signal of the detection unit D1 is input to the calculation device 10 following a detection signal of the detection unit D2, D4, or D5, the alert may be issued if a detection signal of a detection unit other than the detection unit D1 is input to the calculation device 10. This means that, even though a detection signal indicating a return of the resident 60 has not been input to the calculation device 10 after the resident 60 left home, a detection signal indicating the presence of a person inside the dwelling 50 is input to the calculation device 10. In this case, issuance of the alert may enable detection of attempted burglary.

In the foregoing embodiment, the alert may be issued when detection signals are sequentially input from different detection units to the calculation device 10 and the installation information storage unit 16 does not store a reference activity amount corresponding to the combination of the different detection units. Specifically, referring to FIGS. 3 and 5, there is a possibility of failure in the detection unit D3 or D5 when, for example, a detection signal output from the detection unit D6 is input to the calculation device 10 following a detection signal output from the detection unit D4. In this case, issuance of the alert may enable early detection of a failed detection unit.

In the foregoing embodiment, activity amounts of the resident 60 living alone are calculated. In order to calculate activity amounts of a plurality of residents, it is preferable to change the arrangements (e.g., heights), settings, types, and the like of detection units as appropriate in consideration of, for example, the heights or weights of the residents.

[Program]

It is sufficient for the program according to the embodiment of the present invention to cause a computer to execute steps S1 to S8 shown in FIG. 6. The activity amount calculation device and the activity amount calculation method according to the present embodiment can be realized by installing this program in the computer and executing the installed program. In this case, a central processing unit (CPU) of the computer serving as the calculation device functions as the calculation unit 11, summation unit 12, data collection unit 13, timer 14, alert unit 18, and transmission unit 19, and executes processing.

In the present embodiment, the detection information storage unit 15, installation information storage unit 16, and activity amount storage unit 17 are realized by storing a data file for configuring them to a hard disk or a similar storage device provided in the computer, or by loading a recording medium having stored therein this data file to a reading device that is connected to the computer.

[Physical Configuration]

Figure 7:
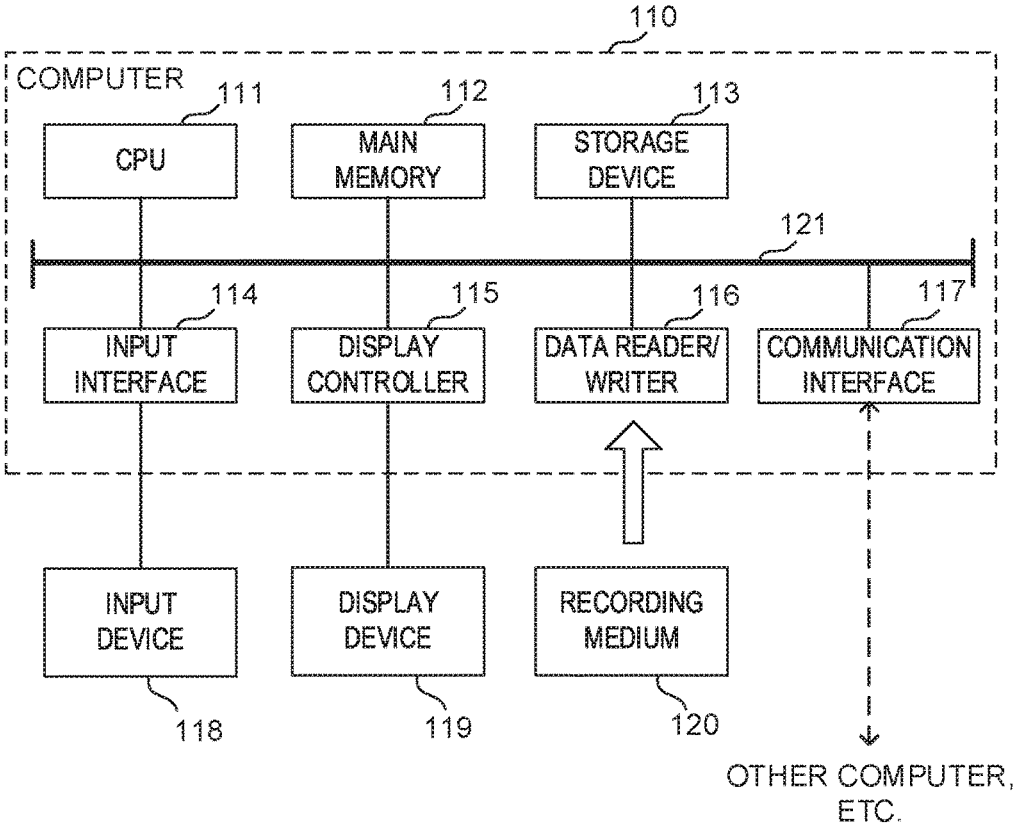
FIG. 7 is a block diagram showing an example of a computer that realizes an activity amount calculation device according to the embodiment of the present invention.

A description is now given of the computer that realizes the activity amount calculation device by executing the program according to the present embodiment with reference to a drawing. FIG. 7 is a block diagram showing an example of the computer that realizes the activity amount calculation device according to the embodiment of the present invention.

As shown in FIG. 7, a computer 110 includes a CPU 111, a main memory 112, a storage device 113, an input interface 114, a display controller 115, a data reader/writer 116, and a communication interface 117. These components are connected in such a manner that they can perform data communication with one another via a bus 121.

The CPU 111 performs various types of calculation by deploying the program (code) according to the present embodiment stored in the storage device 113 to the main memory 112, and executing the deployed program in a predetermined order. The main memory 112 is typically a volatile storage device, such as a dynamic random-access memory (DRAM). The program according to the present embodiment is provided while being stored in a computer-readable recording medium 120. The program according to the present embodiment may be distributed over the Internet connected via the communication interface 117.

Specific examples of the storage device 113 include a hard disk drive and a semiconductor storage device, such as a flash memory. The input interface 114 mediates data transmission between the CPU 111 and an input device 118, such as a keyboard and a mouse. The display controller 115 is connected to a display device 119, and controls display on the display device 119.

The data reader/writer 116 mediates data transmission between the CPU 111 and the recording medium 120. The data reader/writer 116 reads out the program from the recording medium 120, and writes the result of processing of the computer 110 to the recording medium 120. The communication interface 117 mediates data transmission between the CPU 111 and other computers.

Specific examples of the recording medium 120 include: a general-purpose semiconductor storage device, such as CompactFlash® (CF) and Secure Digital (SD); a magnetic storage medium, such as a flexible disk; and an optical storage medium, such as a compact disc read-only memory (CD-ROM).

A part or an entirety of the foregoing embodiment can be described as, but is not limited to, the following Supplementary Notes 1 to 24.

(Supplementary Note 1)

An activity amount calculation system for calculating activity amounts of a resident of a dwelling equipped with a plurality of rooms, the activity amount calculation system including:

a plurality of detection units configured to detect the resident and output detection signals when the resident passes through doorways of the plurality of rooms;

a calculation unit configured to calculate activity amounts of the resident based on the detection signals output from the plurality of detection units; and a summation unit configured to repeatedly calculate a total activity amount of the resident in a predetermined period by summing the activity amounts calculated by the calculation unit, wherein upon detection of the resident by different detection units included among the plurality of detection units, the calculation unit calculates an activity amount of the resident based on a preset relationship between the different detection units and a reference activity amount.

(Supplementary Note 2)

The activity amount calculation system according to Supplementary Note 1, wherein upon detection of the resident by the different detection units, the calculation unit uses the reference activity amount obtained from the relationship between the different detection units and the reference activity amount as the activity amount of the resident when an elapsed period between detection by one of the different detection units that has detected first and detection by another of the different detection units that has detected second is longer than or equal to a preset reference period, and uses a product of the reference activity amount obtained from the relationship between the different detection units and the reference activity amount and a coefficient larger than one as the activity amount of the resident when the elapsed period is shorter than the reference period.

(Supplementary Note 3)

The activity amount calculation system according to Supplementary Note 1, further including an alert unit configured to issue an alert when a difference between the total activity amount calculated by the summation unit and an average value of a predetermined number of total activity amounts calculated by the summation unit in and before the last calculation exceeds a preset threshold.

(Supplementary Note 4)

The activity amount calculation system according to Supplementary Note 1, further including an alert unit configured to issue an alert when the total activity amount calculated by the summation unit exceeds a preset upper limit.

(Supplementary Note 5)

The activity amount calculation system according to Supplementary Note 1, further including an alert unit configured to issue an alert when the total activity amount calculated by the summation unit falls below a preset lower limit.

(Supplementary Note 6)

The activity amount calculation system according to Supplementary Note 1, wherein each activity amount is expressed as a distance.

(Supplementary Note 7)

An activity amount calculation device for calculating activity amounts of a resident of a dwelling equipped with a plurality of rooms, the activity amount calculation device including:

a calculation unit configured to calculate activity amounts of the resident based on detection signals output from a plurality of detection devices that detect the resident when the resident passes through doorways of the plurality of rooms; and a summation unit configured to repeatedly calculate a total activity amount of the resident in a predetermined period by summing the activity amounts calculated by the calculation unit, wherein upon detection of the resident by different detection devices included among the plurality of detection devices, the calculation unit calculates an activity amount of the resident based on a preset relationship between the different detection devices and a reference activity amount.

(Supplementary Note 8)

The activity amount calculation device according to Supplementary Note 7, wherein upon detection of the resident by the different detection devices, the calculation unit uses the reference activity amount obtained from the relationship between the different detection devices and the reference activity amount as the activity amount of the resident when an elapsed period between detection by one of the different detection devices that has detected first and detection by another of the different detection devices that has detected second is longer than or equal to a preset reference period, and uses a product of the reference activity amount obtained from the relationship between the different detection devices and the reference activity amount and a coefficient larger than one as the activity amount of the resident when the elapsed period is shorter than the reference period.

(Supplementary Note 9)

The activity amount calculation device according to Supplementary Note 7, further including an alert unit configured to issue an alert when a difference between the total activity amount calculated by the summation unit and an average value of a predetermined number of total activity amounts calculated by the summation unit in and before the last calculation exceeds a preset threshold.

(Supplementary Note 10)

The activity amount calculation device according to Supplementary Note 7, further including an alert unit configured to issue an alert when the total activity amount calculated by the summation unit exceeds a preset upper limit.

(Supplementary Note 11)

The activity amount calculation device according to Supplementary Note 7, further including an alert unit configured to issue an alert when the total activity amount calculated by the summation unit falls below a preset lower limit.

(Supplementary Note 12)

The activity amount calculation device according to Supplementary Note 7, wherein each activity amount is expressed as a distance.

(Supplementary Note 13)

An activity amount calculation method of calculating activity amounts of a resident of a dwelling equipped with a plurality of rooms using an activity amount calculation device, the activity amount calculation method including:

(a) a step of calculating activity amounts of the resident based on detection signals output from a plurality of detection devices that detect the resident when the resident passes through doorways of the plurality of rooms; and (b) a step of repeatedly calculating a total activity amount of the resident in a predetermined period by summing the activity amounts calculated in step (a), wherein in step (a), upon detection of the resident by different detection devices included among the plurality of detection devices, an activity amount of the resident is calculated based on a preset relationship between the different detection devices and a reference activity amount.

(Supplementary Note 14)

The activity amount calculation method according to Supplementary Note 13, wherein in step (a), upon detection of the resident by the different detection devices, the reference activity amount obtained from the relationship between the different detection devices and the reference activity amount is used as the activity amount of the resident when an elapsed period between detection by one of the different detection devices that has detected first and detection by another of the different detection devices that has detected second is longer than or equal to a preset reference period, and a product of the reference activity amount obtained from the relationship between the different detection devices and the reference activity amount and a coefficient larger than one is used as the activity amount of the resident when the elapsed period is shorter than the reference period.

(Supplementary Note 15)

The activity amount calculation method according to Supplementary Note 13, further including:

(c) a step of issuing an alert when a difference between the total activity amount calculated in step (b) and an average value of a predetermined number of total activity amounts calculated in and before the last calculation exceeds a preset threshold.

(Supplementary Note 16)

The activity amount calculation method according to Supplementary Note 13, further including:

(d) a step of issuing an alert when the total activity amount calculated in step (b) exceeds a preset upper limit.

(Supplementary Note 17)

The activity amount calculation method according to Supplementary Note 13, further including:

(e) a step of issuing an alert when the total activity amount calculated in step (b) falls below a preset lower limit.

(Supplementary Note 18)

The activity amount calculation method according to Supplementary Note 13, wherein each activity amount is expressed as a distance.

(Supplementary Note 19)

A computer-readable recording medium having recorded therein a program for calculating activity amounts of a resident of a dwelling equipped with a plurality of rooms using a computer, the program including an instruction for causing the computer to execute:

(a) a step of calculating activity amounts of the resident based on detection signals output from a plurality of detection devices that detect the resident when the resident passes through doorways of the plurality of rooms; and (b) a step of repeatedly calculating a total activity amount of the resident in a predetermined period by summing the activity amounts calculated in step (a), wherein in step (a), upon detection of the resident by different detection devices included among the plurality of detection devices, an activity amount of the resident is calculated based on a preset relationship between the different detection devices and a reference activity amount.

(Supplementary Note 20)

The computer-readable recording medium according to Supplementary Note 19, wherein in step (a), upon detection of the resident by the different detection devices, the reference activity amount obtained from the relationship between the different detection devices and the reference activity amount is used as the activity amount of the resident when an elapsed period between detection by one of the different detection devices that has detected first and detection by another of the different detection devices that has detected second is longer than or equal to a preset reference period, and a product of the reference activity amount obtained from the relationship between the different detection devices and the reference activity amount and a coefficient larger than one is used as the activity amount of the resident when the elapsed period is shorter than the reference period.

(Supplementary Note 21)

The computer-readable recording medium according to Supplementary Note 19, wherein the program further includes an instruction for causing the computer to execute:

(c) a step of issuing an alert when a difference between the total activity amount calculated in step (b) and an average value of a predetermined number of total activity amounts calculated in and before the last calculation exceeds a preset threshold.

(Supplementary Note 22)

The computer-readable recording medium according to Supplementary Note 19, wherein the program further includes an instruction for causing the computer to execute:

(d) a step of issuing an alert when the total activity amount calculated in step (b) exceeds a preset upper limit.

(Supplementary Note 23)

The computer-readable recording medium according to Supplementary Note 19, wherein the program further includes an instruction for causing the computer to execute:

(e) a step of issuing an alert when the total activity amount calculated in step (b) falls below a preset lower limit.

(Supplementary Note 24)

The computer-readable recording medium according to Supplementary Note 19, wherein each activity amount is expressed by a distance.

Although the invention of the present application has been described thus far with reference to the embodiment, the invention of the present application is not limited to the foregoing embodiment. Various changes that can be understood by a person skilled in the art can be made to the configurations and details of the invention of the present application within the scope of the invention of the present application.

The present application claims the benefit of priority from Japanese Patent Application No. 2015-73769, filed Mar. 31, 2015, the disclosure of which is incorporated herein by reference in its entirety.

INDUSTRIAL APPLICABILITY

As described above, according to the present invention, a change in an activity amount of a resident can be precisely grasped while reducing a burden on the resident. Therefore, the present invention is useful when, for example, it is necessary to remotely grasp the health of an elderly person living alone.

REFERENCE SIGNS LIST

10 activity amount calculation device
11 calculation unit
12 summation unit
13 data collection unit
14 timer
15 detection information storage unit
16 installation information storage unit
17 activity amount storage unit
18 alert unit
19 transmission unit
50 dwelling
60 resident
100 activity amount calculation system
D1 to D6 detection unit
DR1 to DR6 doorway
110 computer
111 CPU
112 main memory
113 storage device
114 input interface
115 display controller
116 data reader/writer
117 communication interface
118 input device
119 display device
120 recording medium
121 bus

The invention claimed is:

1. A computer configured as an activity amount calculation device for calculating activity amounts of a resident of a dwelling equipped with a plurality of rooms, the activity amount calculation device comprising:

a calculation unit configured to calculate activity amounts of the resident based on detection signals output from a plurality of detection devices that detect the resident when the resident passes through doorways of the plurality of rooms; and a summation unit configured to repeatedly calculate a total activity amount of the resident in a predetermined period by summing the activity amounts calculated by the calculation unit, wherein upon detection of the resident by different detection devices included among the plurality of detection devices, the calculation unit calculates an activity amount of the resident based on a preset relationship between the different detection devices and a reference activity amount, wherein the calculation unit uses the reference activity amount as the activity amount of the resident when an elapsed period between detection by one of the different detection devices that has detected first and detection by another of the different detection devices that has detected second is longer than or equal to a preset reference period, and the calculation unit uses a product of the reference activity amount and a coefficient larger than one as the activity amount of the resident when the elapsed period is shorter than the reference period.

2. The activity amount calculation device according to claim 1, further comprising an alert unit configured to issue an alert when a difference between the total activity amount calculated by the summation unit and an average value of a predetermined number of total activity amounts calculated by the summation unit in and before the last calculation exceeds a preset threshold.

3. The activity amount calculation device according to claim 1, further comprising an alert unit configured to issue an alert when the total activity amount calculated by the summation unit exceeds a preset upper limit.

4. The activity amount calculation device according to claim 1, further comprising an alert unit configured to issue an alert when the total activity amount calculated by the summation unit falls below a preset lower limit.

5. The activity amount calculation device according to claim 1, wherein each activity amount is expressed as a distance.

6. An activity amount calculation method of calculating activity amounts of a resident of a dwelling equipped with a plurality of rooms using an activity amount calculation device, the activity amount calculation method performed by a computer and comprising:

(a) a step of calculating activity amounts of the resident based on detection signals output from a plurality of detection devices that detect the resident when the resident passes through doorways of the plurality of rooms; and (b) a step of repeatedly calculating a total activity amount of the resident in a predetermined period by summing the activity amounts calculated in step (a), wherein in step (a), upon detection of the resident by different detection devices included among the plurality of detection devices, an activity amount of the resident is calculated based on a preset relationship between the different detection devices and a reference activity amount, wherein the calculation unit uses the reference activity amount as the activity amount of the resident when an elapsed period between detection by one of the different detection devices that has detected first and detection by another of the different detection devices that has detected second is longer than or equal to a preset reference period, and the calculation unit uses a product of the reference activity amount and a coefficient larger than one as the activity amount of the resident when the elapsed period is shorter than the reference period.

7. The activity amount calculation method according to claim 6, further comprising:

(c) a step of issuing an alert when a difference between the total activity amount calculated in step (b) and an average value of a predetermined number of total activity amounts calculated in and before the last calculation exceeds a preset threshold.

8. The activity amount calculation method according to claim 6, further comprising:

(d) a step of issuing an alert when the total activity amount calculated in step (b) exceeds a preset upper limit.

9. The activity amount calculation method according to claim 6, further comprising:

(e) a step of issuing an alert when the total activity amount calculated in step (b) falls below a preset lower limit.

10. The activity amount calculation method according to claim 6, wherein each activity amount is expressed as a distance.

11. A non-transitory computer-readable recording medium having recorded therein a program for calculating activity amounts of a resident of a dwelling equipped with a plurality of rooms using a computer, the program including an instruction for causing a processor of the computer to execute:

(a) a step of calculating activity amounts of the resident based on detection signals output from a plurality of detection devices that detect the resident when the resident passes through doorways of the plurality of rooms; and (b) a step of repeatedly calculating a total activity amount of the resident in a predetermined period by summing the activity amounts calculated in step (a), wherein in step (a), upon detection of the resident by different detection devices included among the plurality of detection devices, an activity amount of the resident is calculated based on a preset relationship between the different detection devices and a reference activity amount, wherein the calculation unit uses the reference activity amount as the activity amount of the resident when an elapsed period between detection by one of the different detection devices that has detected first and detection by another of the different detection devices that has detected second is longer than or equal to a preset reference period, and the calculation unit uses a product of the reference activity amount and a coefficient larger than one as the activity amount of the resident when the elapsed period is shorter than the reference period.

12. The non-transitory computer-readable recording medium according to claim 11, wherein the program further includes an instruction for causing the computer to execute:

(c) a step of issuing an alert when a difference between the total activity amount calculated in step (b) and an average value of a predetermined number of total activity amounts calculated in and before the last calculation exceeds a preset threshold.

13. The non-transitory computer-readable recording medium according to claim 11, wherein the program further includes an instruction for causing the computer to execute:

(d) a step of issuing an alert when the total activity amount calculated in step (b) exceeds a preset upper limit.

14. The non-transitory computer-readable recording medium according to claim 11, wherein the program further includes an instruction for causing the computer to execute:

(e) a step of issuing an alert when the total activity amount calculated in step (b) falls below a preset lower limit.

15. The non-transitory computer-readable recording medium according to claim 11, wherein each activity amount is expressed by a distance.

* * * * *